United States Patent [19]

Knestele

[11] 4,349,935

[45] Sep. 21, 1982

[54] RUG AND CARPET CLEANING APPARATUS

[76] Inventor: Leopold Knestele, Postfach 1241, D 7967 Bad Waldsee, Fed. Rep. of Germany

[21] Appl. No.: 164,532

[22] Filed: Jul. 2, 1980

[30] Foreign Application Priority Data

Jan. 24, 1980 [DE] Fed. Rep. of Germany ..... 3002422

[51] Int. Cl.[3] ..... A47L 11/30

[52] U.S. Cl. ..... 15/320; 15/328; 15/355; 15/365; 15/366; 15/373

[58] Field of Search ..... 15/320, 328, 384, 355, 15/364, 365, 366, 368, 373

[56] References Cited

U.S. PATENT DOCUMENTS

| | | | |
|---|---|---|---|
| 1,176,990 | 3/1916 | Scherff | 15/320 |
| 2,557,216 | 6/1951 | Calabrese | 15/320 X |
| 2,622,254 | 12/1952 | Mendelson | 15/320 X |
| 3,942,215 | 3/1976 | Olds | 15/320 |
| 4,041,567 | 8/1977 | Burgoon | 15/373 X |
| 4,096,601 | 6/1978 | Knestele | 15/320 |

FOREIGN PATENT DOCUMENTS

| | | | |
|---|---|---|---|
| 109854 | 4/1925 | Switzerland | 15/384 |
| 610918 | 10/1948 | United Kingdom | 15/384 |

*Primary Examiner*—Chris K. Moore
*Attorney, Agent, or Firm*—Montague & Ross

[57] ABSTRACT

A rug and carpet cleaning apparatus of the type in which a housing is shifted along the floor and is connected to a suction chamber while having rotary brush, carpet-shampoo, massager, and like rotary units which are selectively to act upon the carpet depending upon the function or operation to be carried out. According to the invention, at least two such units are provided on opposite sides of the fulcrum or pivot of a rocker or teeter which is controlled, e.g. by a lever and cable arrangement, to selectively bring one or the other unit into action depending upon the tilt imparted to the rocker. Both units can be continuously coupled to the drive motor which can also be mounted on the rocker.

12 Claims, 8 Drawing Figures

RUG AND CARPET CLEANING APPARATUS

FIELD OF THE INVENTION

My present invention relates to a rug and carpet cleaning apparatus and, more particularly, to a versatile rug and carpet cleaning apparatus capable of dry or wet cleaning of a rug or carpet, i.e. for use with or without rug shampoo, for vacuuming exclusively or for vacuuming coupled with shampooing.

BACKGROUND OF THE INVENTION

In my U.S. Pat. No. 4,096,601, for example, and elsewhere there are described multipurpose rug and carpet cleaning heads having a plurality of units which may be made effective to carry out various rug or carpet cleaning tasks. It is, for example, known to provide a rotating brush (brush unit), a foam applicator which can include a second rotary unit adapted to generate foam from a liquid canister dispensed onto the carpet, a suction device capable of drawing liquid or air from the surface of the carpet, and various ancillary means such as a valve or dispenser for the liquid, a bag, canister or other holder for dry soil, a container for wet soil or liquid drawn from the carpet and various means for placing the selected units in operation.

Switch levers for the latter purpose, for example, are provided on the housing or floor-treating head and on the handle for displacing the head and generally operate respective cables such as Bowden lines, for coupling the unit which is to operate with a rotary drive having a fixed axis in the housing of the head.

The difficulty with this arrangement is that it is of complex construction and difficult or complex to operate, since a respective switch element is required for each unit which can be placed in or cut out of operation.

Because of the complexity of earlier switching devices, moreover, the head usually must be of inconveniently large dimensions and weight.

Furthermore, where a number of units are selectively coupled to a given drive by transmissions which can be switched on or off, problems are encountered with wear of the transmission parts.

OBJECTS OF THE INVENTION

It is an important object of the present invention to provide an improved but simplified control system for a rug or carpet cleaning apparatus whereby the disadvantages of earlier systems are avoided.

Another object of this inventioon is to provide a rug or carpet cleaning head for a multipurpose cleaning apparatus whereby switchover between functions is facilitated and the head is of comparatively light weight and small dimensions.

Yet another object of this invention is to provide a carpet and rug cleaning apparatus for the purposes described having a more reliable and easily operated control system.

SUMMARY OF THE INVENTION

These objects and others which will become apparent hereinafter are attained, in accordance with the present invention, in a rug and carpet cleaning head having at least two rotary units for alternative and selective application to the rug or carpet cleaning surface and both driven by a common drive motor, the two units and preferably also the drive motor being mounted upon a rocker or teeter which is fulcrumed in and pivotally connected to the head housing so that, depending upon the tilt of the rocker about its fulcrum, one or the other unit comes into play and the units can be utilized alternatively.

The rocker or teeter is elongated in the longitudinal direction of the head, i.e. in the direction of normal back-and-forth displacement of the head and has two lever arms which are actuated by a control from the handle of the carpet cleaning apparatus to change the directions in which they are slued to the carpet surface and hence which of the units is effective.

At least one of the units is preferably the rotating brush which is connected continuously with the drive motor.

According to a further feature of the invention, the rocker or teeter comprises a pair of lateral longitudinally extending frame elements which are bridged by the rotatable members of the respective units and journal them while carrying the motor. The frame elements can support the swivel shaft and the bearings of the working units as well as the accessories of the latter, and a hood for covering the foaming or foam-producing unit. Advantageously, a cam lever actuated by a member or element cooperates with a part of the frame forming the rocker and effects the tilting thereof.

This lever, in addition, can be coupled by a tractive member to a lever electrically controlling the drive motor for the unit placed in operation.

The tractive or pulling members which are preferred in accordance with this invention, are Bowden cables which can operate, or be operated by, respective levers.

This arrangement has the obvious advantage that separate function wheel transmissions for the respective rotatable units can be completely eliminated and that at least one of the units is continuously driven, i.e. in a constant operative connection with the motor. Selection between the operative units is effected by tilting the rocker in the respective sense. Since the motor can remain on in all phases of operation of the carpet cleaning head, the need for switches controlled by the selector lever for turning on and off the motor is eliminated as well.

I have also found it to be advantageous to provide in the bottom of the housing or casing a floor having spaced apart and thus separate suction inlets, one rearwardly of the other in the direction of advance of the head. The suction inlets are connectable through a tiltable control valve alternatively with a soil-collection space to provide a vacuum or suction effect.

The control valve is provided with a lever arm connected with the cam lever by a tractive element so that the control valve is switched synchronously with displacement of the rocker against the counteracting force of a spring.

With appropriate rotary units, the carpet cleaning head can carry out dry brushing and vacuuming, or wet or dry vacuuming, or shampooing with evacuation of the foam and cleaning agent.

For large areas where more powerful units are required, it has been found to be advantageous to massage the carpet surface by a so-called massaging roller (see the above-mentioned patent) which assists in effective foam cleaning of the carpet fibers and surfaces.

Since the so-called massage roller receives a pulsating movement by rotation, it can additionally be provided on the rocker and can be continuously connected to the drive motor.

It has been found to be advantageous to provide the massage roller so that it is coaxial with the fulcrum of the rocker and is permanently connected to the rotating brush.

BRIEF DESCRIPTION OF THE DRAWING

The above and other objects, features and advantages will become more readily apparent from the following description, reference being made to the accompanying drawing in which.

SPECIFIC DESCRIPTION

Figure 1:
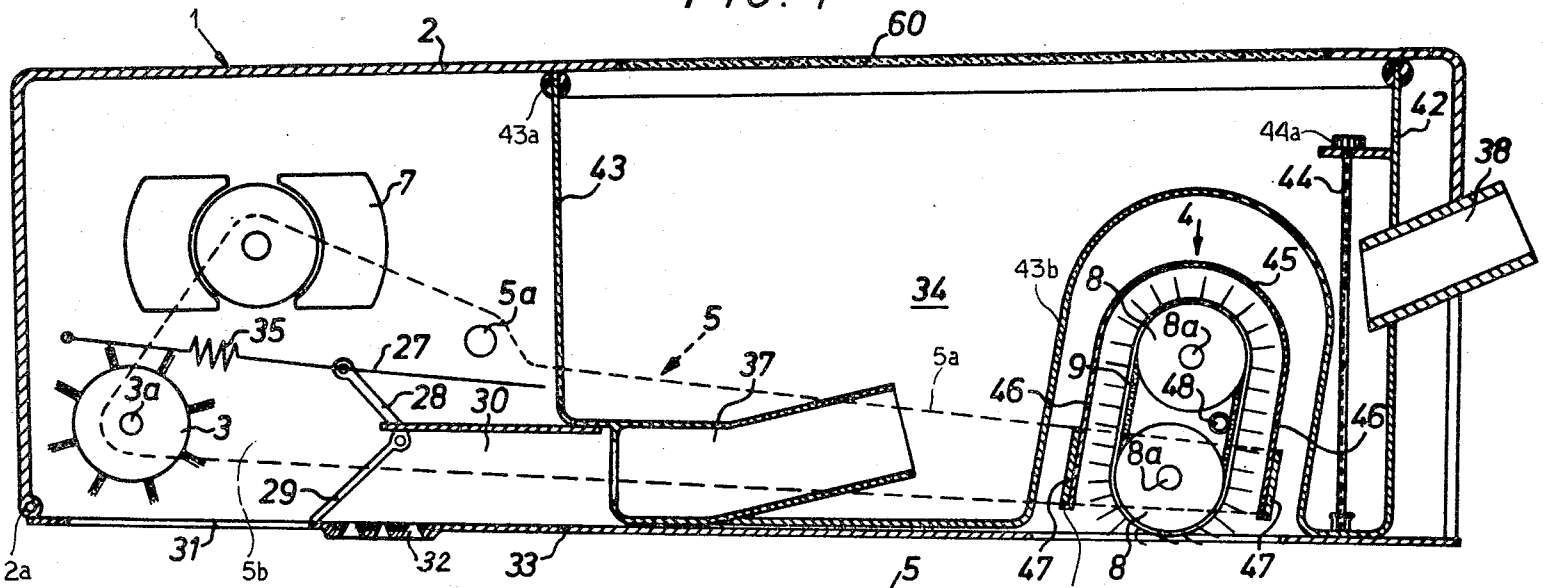
FIG. 1 is a longitudinal cross section through a rug cleaning apparatus according to a feature of the invention.
Figure 4:
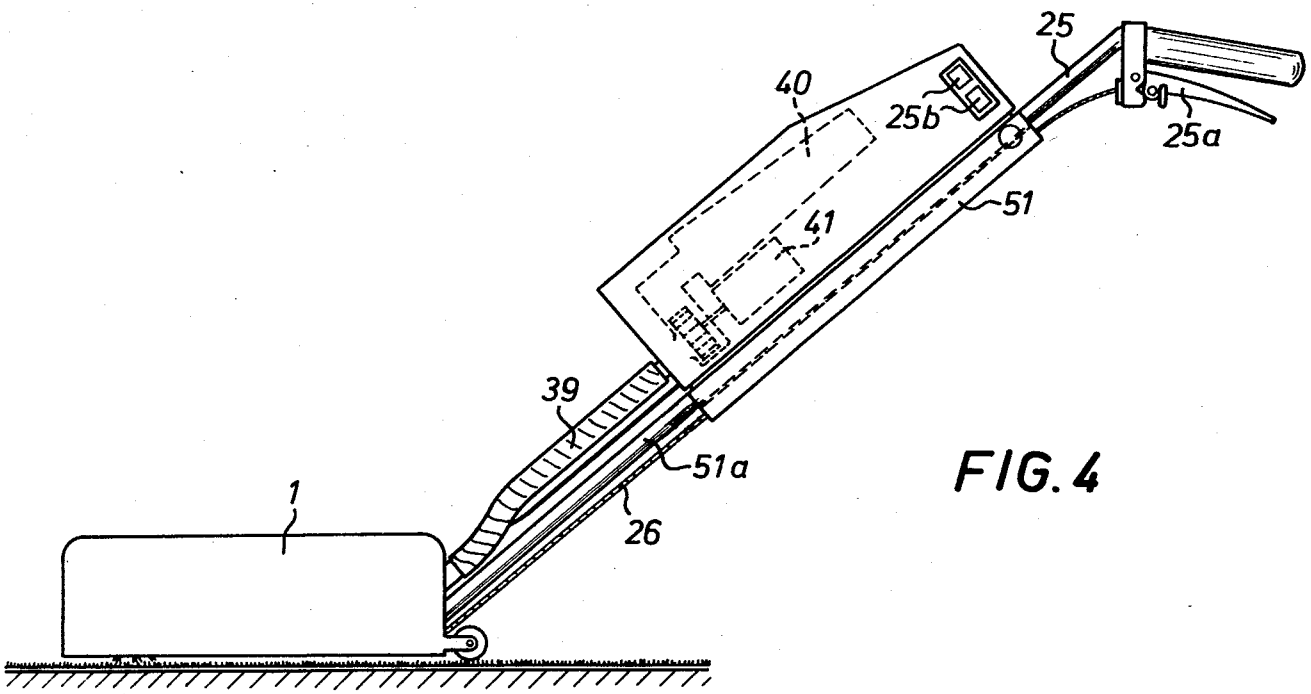
FIG. 4 is a diagrammatic side elevational view showing the entire apparatus using the head of FIGS. 1 and 2.

In FIG. 1 I have shown the floor-engaging cleaning head of a rug or carpet cleaning machine capable of dry vacuuming or shampooing, selectively under the control of an actuating lever on the handle of the machine (see FIG. 4).

This head comprises a casing 1 having a hinged lid 2 which can be swung in the counterclockwise sense about the pivot 2*a* to afford access to the operative units within the housing 1.

In the interior of the housing 1, two working units 3 and 4 are provided each including at least one rotary member driven by a motor 7. The rotary units in this embodiment are the rotating brush 3 and the foaming unit 4.

The rotating working units 3 and 4 are mounted on a rocker 5 having arms 5*a* and 5*b* to opposite sides of a fulcrum or pivot.

Figure 2:
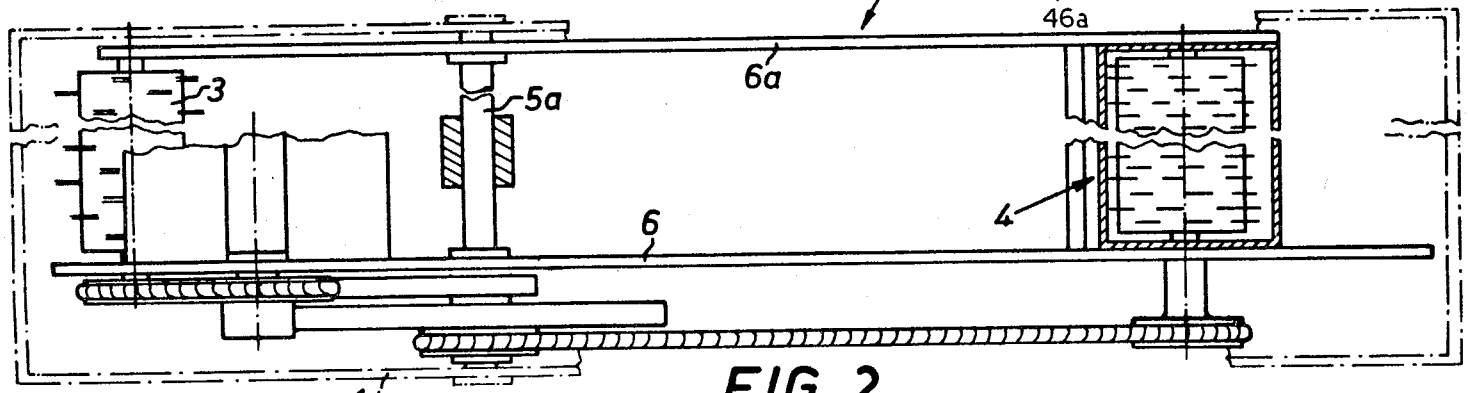
FIG. 2 is a fragmentary plan view showing the rocker of FIG. 1 and the housing indicated only in dot-dash lines.

The rocker can be formed by a pair of lateral, longitudinally extending frame members 6 and 6*a* which are bridged by the working units to form the frame (see FIG. 2).

On one side of the fulcrum 5*a,* i.e. toward the front, the rocker 5 carries the shaft 3*a* and the rotary brush 3 as well as the motor 7 while, on the opposite side of the fulcrum 5 a pair of rollers 8 and their respective shafts 8*a,* the rollers 8 being spanned by a belt in the form of a sponge tape 9 for generating foam on the carpet in the manner described in my aforementioned patent.

Figure 3:
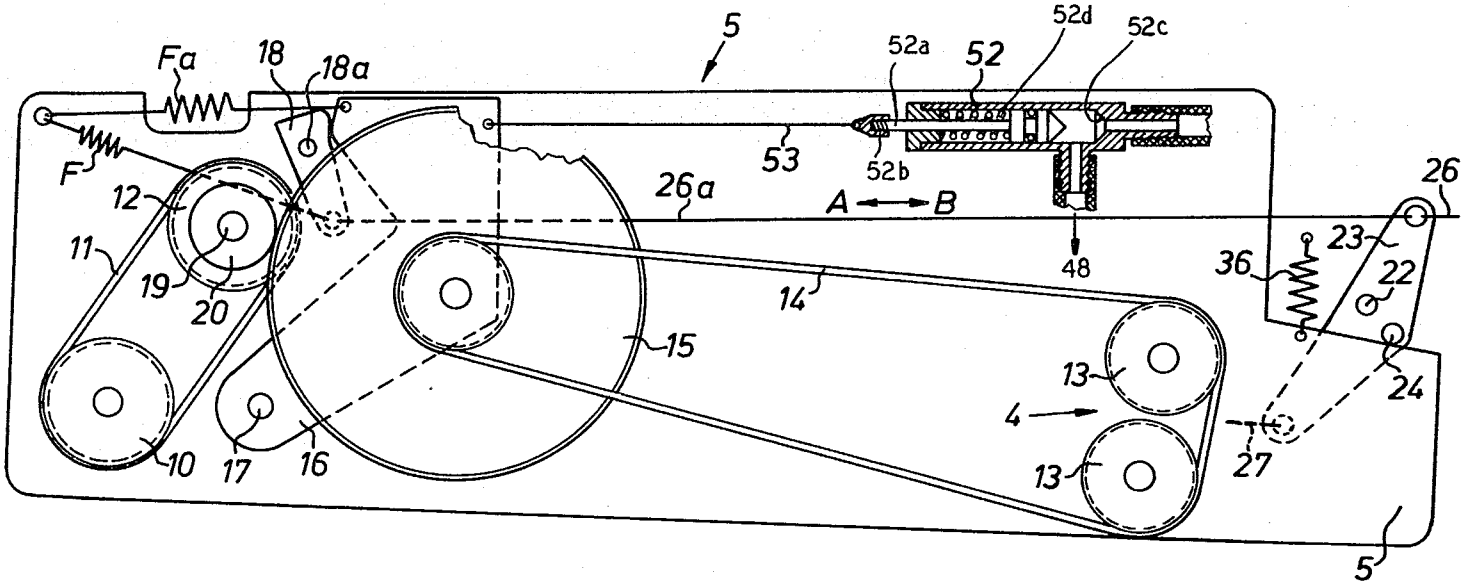
FIG. 3 is a side view of the rocker of FIG. 2.

As can be seen from FIG. 3, moreover, the drive wheel 10 of the rotating brush 3 is connected with the drive wheel 12 of motor 7 by a belt so that the brush 3 is continuously driven.

The drive pulleys 13 for the foaming rollers and belt 8,9, are connected by a belt 14 with a friction wheel 15 journaled on an arm 16 which is swingable about the axis of a shaft 17 also fastened in the rocker frame 5.

The arm 16 is shiftable by a lever 18 pivoted at 18*a* to the housing so that the friction wheel can be brought to bear peripherally against a drive wheel 20, also of the friction type, mounted on the motor shaft 19. The frictional contact is applied under the spring force Fa (FIG. 3) and the wheels 20 and 15 are respectively relatively small and relatively large to reduce the angular velocity transmitted to the foaming unit 4. In this embodiment, a single friction coupling is provided for one of the driven units while the other driven unit is continuously connected to the motor.

Naturally both of the rotatable units carried by the rocker may be continuously driven by the motor which is also mounted on the rocker, e.g. via respective belts.

Thus when the switch lever 18 is displaced by the operator via cable 26*a* about the pivot 18*a,* the friction wheel 15 engages the friction wheel 20 and rotary action is transmitted with the significantly reduced speed in a practically noiseless operation.

To selectively tilt the rocker 5 and thereby selectively bring the units 3 and 4 alternatively into action, a double-arm cam lever 23 is rotatably mounted on a shaft 22 fixed to the housing or casing.

The cam lever has a cam 24 which rests against a ledge of the rocker frame 5 so that the latter forms a cam follower.

One of the arms of the cam lever is connected with the cable 26 which runs along the handle of the apparatus (FIG. 4) terminating in an actuating lever 25*a* which is pivotally connected to the upper end of the handle 25 so that it can be engaged by the operator to draw the cable 26 upwardly.

The other arm of the cam lever is connected to a cable 27 which leads to a lever arm 28 of a control valve 29 which is pivotally mounted at the intake end of a suction duct 30 selectively connecting one or both of the suction inlets 31 and 32 in the casing bottom 33 with the suction duct 30 which opens into the suction space.

The cable 27 acts against the force of a tension spring 35.

In the position of the valve 29 and the cam lever 23 shown in FIG. 3, the rocker 5 is tilted downwardly and rearwardly to bring the foaming unit 4 into play while stretching the spring 36 which is stretched between the rocker and the casing.

This downward movement of the foaming unit 4 at the same time actuates the lever 18 to permit force transmission between the friction wheels 15 and 20. The unit 14 is then effective to generate foam and apply it to the carpet while the wet soil is drawn into the space 34 through the inlet 32 and a connecting duct 37, the communication of suction to the inlet 31 being blocked.

The displacement of the cable 26*a,* moreover, is effective against a tension spring of force F.

In order to prevent the wet mass deposited in the suction space 34 from flowing back out through the inlet 32, the connection duct is inclined rearwardly and upwardly, i.e. has a diagonal inclination.

Suction is applied through a hose 39 to the fitting 38 communicating with the space 34 via dust bag 40 on the handle 25 and a suction blower 41.

To prevent coarse dust particles from entering the dust bag, I have found it to be advantageous to dispose in the chamber 34 ahead of the outlet 38, a coarse filter or sieve plate 44 which is spaced from the rear wall 42 of the space 43, this plate being removable by a handle 44*a* for cleaning as may be required.

In order to discharge the wet mass from chamber 34, the latter can be formed as a container 43 which is received between the frame members 6 and 6a of the rocker and can be removed after opening of the casing cover. The casing cover seals via a seal ring 43a along the upper edge of the container 43. Upon removal of the container 43, which has an upwardly convex bulge 43b in its floor, the foaming unit 4 is made accessible and the rollers 8 can be accessed by inwardly deflecting the U-shaped hood 45 which has elastic walls 46 with ledges 46a engaging beneath cross pieces 47 of the teeter frame 5.

The operation of the foaming unit will be clear from the discussion in U.S. Pat. No. 4,096,601. The foaming agent is introduced by a nozzle 48 or through one of the shafts 8a from a container connected with the nozzle via a valve 52. More particularly, the handle can carry a tank 51, the tank 51 having a pipe 51a running to the valve 52 controlled in accordance with the position of the rocker 5 via a cable 53 connected to the arm 16 so that, when the rocker is tilted to bring the foaming unit 4 into play, the supply of the cleansing agent to the nozzle is open but is closed when the brush 3 is activated. The valve 52 can have a valve stem 52a connected to cable 53 by a threaded coupling 52b, the valve stem being biased in the direction of set 52c by a spring 52d.

When the lever 25a is released, the cable 26 is relaxed and the cam lever 23 swings about the pivot 22 in the counterclockwise sense (FIG. 3) thereby allowing the spring 36 to swing the rocker 5 in the counterclockwise sense (FIG. 1) about the pivot 5a and lift the foaming unit 4 from engagement with the carpet while bringing the rotating brush 3 downwardly through the opening 31 and into an engagement with the carpet. Simultaneously, the spring F operates lever 8 to swing the lever 16 in the counterclockwise sense about the pivot 17, thereby disengaging the friction wheel 15 from wheel 20 and decoupling the belt 14 from the drive motor.

This movement of lever 16 also relaxes the cable 53 allowing the spring 52d to close the valve.

Furthermore, cable 27 is drawn to the right (FIGS. 1 and 3) to swing the valve 29 upwardly and thereby connect the suction chamber 34 to the opening 31, the dust being collected in the bag 40. The lever 25a on the handle 25 can have three detent, indexed (or retained) positions corresponding to operation of unit 4, operation of unit 3 or inactivation of both so that only suction is provided. The switches 25b for the drive motor 7 and the suction motor 41 are mounted near the handle 25a.

Figure 1A:
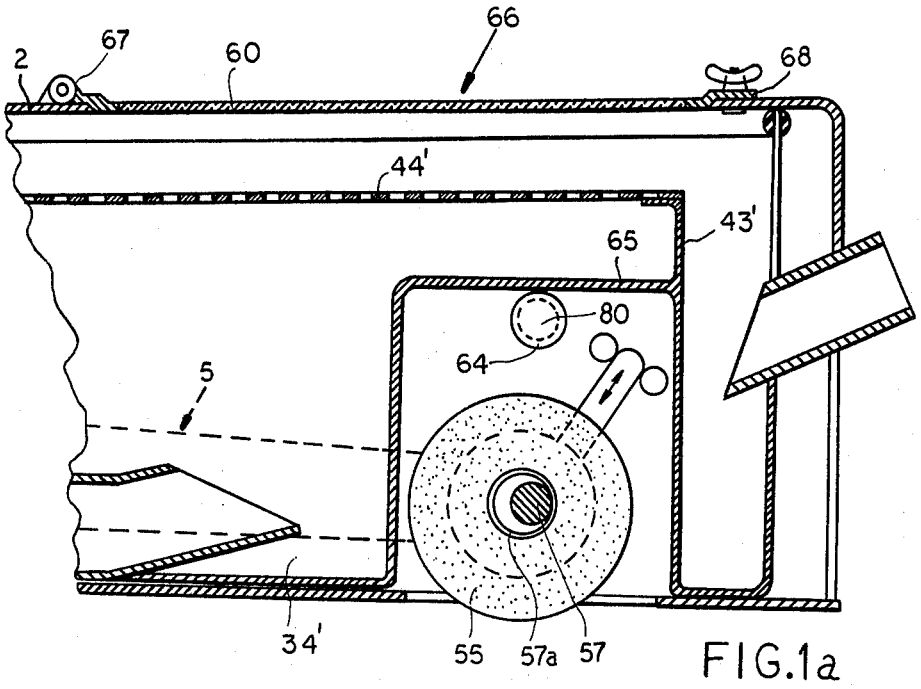
FIG. 1*a* shows a variant, also in cross section, of the rear end of the head of the unit of FIG. 1.
Figure 2A:
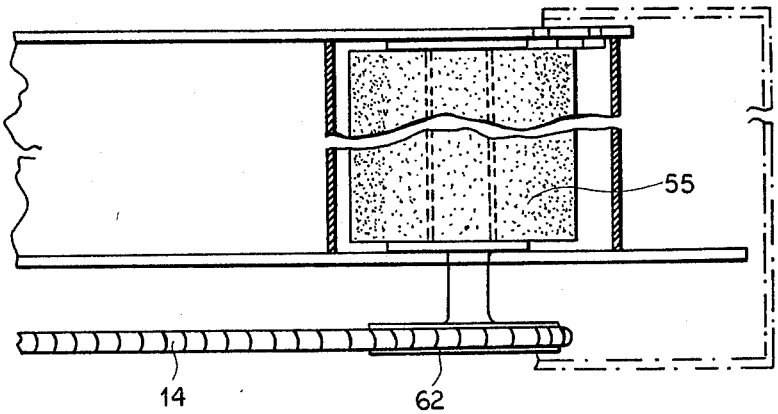
FIG. 2*a* is a view corresponding to FIG. 2 of the embodiment of FIG. 1*a;*

In FIGS. 1a and 1b I have shown a variant in which, in place of the foaming unit 4 previously described, a sponge rubber roll is used as shown at 55, this roll being freely rotating on a shaft 57a which is eccentric to a rotating stud 57, the foaming agent being fed as represented at 80 to this roll. The roll is driven by pulsating action in the manner described for the massaging or scrubbing device in U.S. Pat. No. 4,096,601 and is suitable for scrubbing particularly obstinate and slightly soluble dirt particles from the carpet.

Experience has shown that such pulsating sponge rubber rolls are able to remove even the deepest dirt from the carpet. The sponge rubber roll is driven by wheels 61 and 62 and a belt 14 with speed reduction in the manner analogous to the driving of the foaming unit 4.

Here the filter 44' is provided as the top of the removable container 43' which has a hood 65 overlying the massaging roller. The casing cover 66 can be lifted at hinge 67 upon release of a fastening screw 68 to afford access to the filter 44' and the cover can have a sight glass 60 enabling inspection of the suction space 34' of this embodiment of the invention.

The pipe 80 for supplying the cleaning unit is connected to line 51a and a valve such as the valve 52, while having downwardly turned nozzles 64 dispensing the cleaning solution onto the roller.

Figure 5:
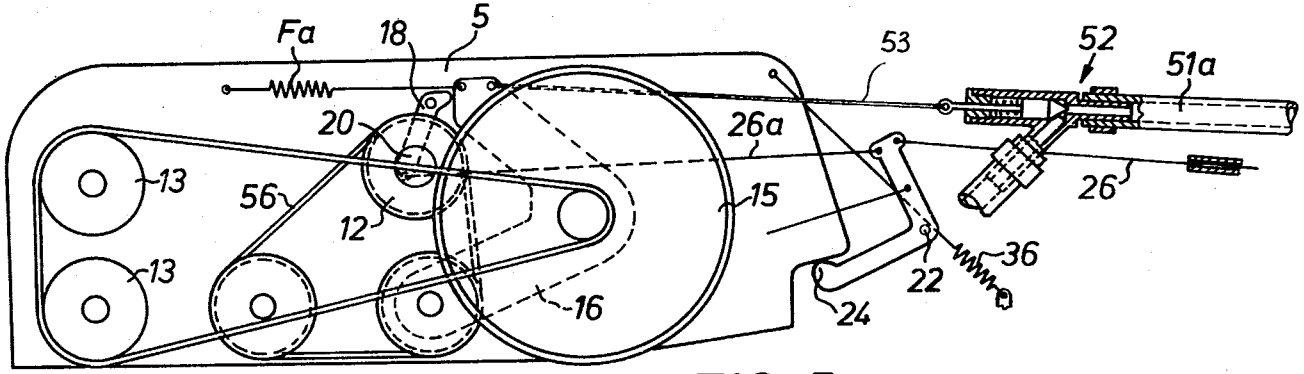
FIG. 5 shows a rocker arrangement for use with three working units (as opposed to the two working units of FIGS. 1 and 2)
Figure 6:
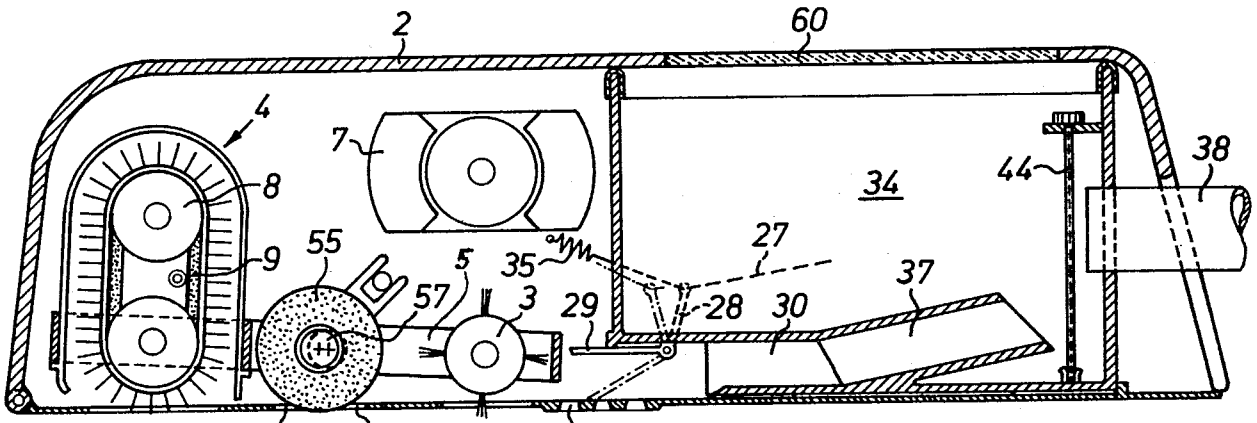
FIG. 6 is a longitudinal section through the head of the apparatus using the rocker of FIG. 5.

FIGS. 5 and 6 show a larger apparatus or more versatile apparatus in accordance with the invention, i.e. an apparatus in which similar reference numerals are used to designate structure functioning in the same manner as previously described but wherein three driven units are provided.

This apparatus differs from the apparatus of FIGS. 1 through 3 by mounting upon the rocker 5 an additional sponge surfaces massaging roller 55 having an eccentric and hence pulsating action.

The units are arranged, front to back, on the rocker, in the following order: foaming unit 4, massaging roll 55 and rotating brush 3.

The massaging roll and the rotation brush are constantly connected to the drive motor 7 by a belt 56 while the foaming unit 4 is driven by a friction wheel clutch 15, 20, controlled by a lever 18 in the manner described, the positions of the teeter, the control valve 29 and the liquid-dispensing valve 52 are controlled from the handle 25 in the manner described as well.

In this case, the massage roll produces a pulsating action which cooperates with either the foaming unit 4 or the brush 3 to promote shampooing and dust pickup, the axis of the massage roll orbiting about the pivot axis of the rocker 5. The massage roll projects through a window 58 in the casing bottom which is spanned by a grating 59 to provide a cleaning and fulling effect upon the massage roll.

I claim:

1. In a rug and carpet cleaning apparatus having a suction source, a source of cleaning liquid and a head displaceable by a handle over a surface of a carpet or rug to be cleaned and connected with said suction source and said liquid source, said head being provided with a driving motor and a plurality of drivable units selectively engageable with said surface and adapted to be coupled with said motor for performing respective cleaning operations upon said surface, said head having a housing receiving said units, the improvement which comprises:

a rocker disposed in said housing and comprising a pair of members extending in a direction of displacement of said head and spaced apart to form opposite members of a frame;

means for pivotally mounting said rocker in said housing on an axis transverse to said direction whereby parts of said rocker to opposite sides of said axis can be brought selectively closer to said surface upon the tilting of said rocker in opposite senses about said axis, said units being respectively mounted on said parts of said rocker for selective approach to said surface, said motor being mounted on said rocker;

means forming a continuous driving connection between said motor and one of said units on said rocker; and means actuatable on said handle for controlling the direction of tilt of said rocker about said axis.

2. The improvement defined in claim 1 wherein said means for controlling the direction of tilt of said rocker comprising:

an actuating lever mounted on said handle;

a flexible tension member connected to said actuating lever; and a cam lever pivotally mounted on said housing and engaging said rocker while being connected to said element.

3. The improvement defined in claim 2, further comprising:

a friction drive on said rocker connecting said motor to the other of said units;

a control arm pivotally mounted in said housing and cooperating with said friction drive for controlling the engagement and disengagement thereof; and a further element operatively connecting said cam lever with said control arm for actuating said friction drive in dependence upon the position of said cam lever.

4. The improvement defined in claim 1 wherein said housing is formed with:

a bottom provided with two suction inlets, one of said suction inlets cooperating with a chamber adapted to receive wet soil, the other suction inlet being spaced from said one suction inlet;

a duct communicating between said other suction inlet and said chamber;

a flap valve pivotally mounted in said housing and adapted to close said duct;

means for connecting said suction source with said chamber; and means operatively connecting said valve with said means for controlling the tilt of said rocker.

5. The improvement defined in claim 4 wherein said duct extends upwardly in said chamber in an inclined path.

6. The improvement defined in claim 5, further comprising a removable sieve plate between said suction source and the interior of said chamber.

7. The improvement defined in claim 5 wherein said housing is provided with an openable cover above said chamber formed with a transparent window.

8. The improvement defined in claim 4 wherein said chamber is a container removable from said housing fitted between said members and adapted to be sealed against said housing.

9. The improvement defined in claim 1 wherein one of said units is a foaming unit including at least one foaming roller and means for dispensing said liquid in the region of said foaming roller, said foaming unit including a downwardly open U-shaped cap detachably affixed to said rocker.

10. The improvement defined in claim 1 wherein said one of said units is a rotating brush.

11. The improvement defined in claim 1 wherein said rocker is provided with a foaming unit, a massaging unit and a rotary-brush unit in succession in said direction, said massaging unit and rotating-brush unit being continuously connected to said motor.

12. The improvement defined in claim 11 wherein said massaging unit is a massaging roller and said housing has a bottom formed with a window of a width corresponding approximately to a quarter of the surface area of said roller and through which said roller engages said surface, said window being covered with a grating.

* * * * *